US008430586B2

(12) United States Patent
Watanabe

(10) Patent No.: US 8,430,586 B2
(45) Date of Patent: Apr. 30, 2013

(54) PRINTING APPARATUS AND CONTROL METHOD OF PRINTING APPARATUS

(75) Inventor: Taichi Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 12/957,302

(22) Filed: Nov. 30, 2010

(65) Prior Publication Data

US 2011/0211898 A1 Sep. 1, 2011

(30) Foreign Application Priority Data

Feb. 26, 2010 (JP) ..... 2010-042346

(51) Int. Cl.
*B41J 11/00* (2006.01)
*B65H 39/10* (2006.01)
*B65H 85/00* (2006.01)

(52) U.S. Cl.
USPC ..... 400/583; 400/582; 400/625; 271/291; 271/298; 271/301; 271/186

(58) Field of Classification Search ..... 400/625; 271/291, 298, 301, 69, 186
See application file for complete search history.

(56) References Cited

U.S. PATENT DOCUMENTS 5,058,879 A * 10/1991 Dunaway ..... 271/259
5,322,274 A * 6/1994 Takahashi et al. ..... 271/258.01
5,625,860 A * 4/1997 Maeda et al. ..... 399/403
5,761,567 A * 6/1998 Yoshizuka ..... 399/17
5,933,677 A * 8/1999 Lee ..... 399/20
6,736,390 B2 * 5/2004 Chihara ..... 271/186
7,018,120 B2 * 3/2006 Takagi ..... 400/582
7,967,290 B2 * 6/2011 Yasui et al. ..... 271/301
8,285,190 B2 * 10/2012 Derimiggio et al. ..... 399/361
2002/0018230 A1 * 2/2002 Iwadate ..... 358/1.14
2002/0051192 A1 * 5/2002 Utsunomiya ..... 358/1.15
2003/0063175 A1 * 4/2003 Nishikawa ..... 347/104
2004/0164487 A1 * 8/2004 Kakigi ..... 271/291
2004/0246325 A1 * 12/2004 Sekiya ..... 347/104
2005/0088504 A1 * 4/2005 Kudoh et al. ..... 347/104
2005/0231578 A1 * 10/2005 Tajima ..... 347/104
2007/0235925 A1 * 10/2007 Johnston et al. ..... 271/301
2007/0273914 A1 * 11/2007 Hosoda ..... 358/1.14
2008/0159800 A1 * 7/2008 Wada ..... 400/621
2009/0041485 A1 * 2/2009 Shoji et al. ..... 399/43
2009/0278308 A1 * 11/2009 Toriyabe et al. ..... 271/298
2010/0044949 A1 * 2/2010 Nakamura ..... 271/3.17
2010/0066782 A1 * 3/2010 Yamamoto et al. ..... 347/16

FOREIGN PATENT DOCUMENTS

JP 05105321 A * 4/1993
JP 07117285 A * 5/1995
JP 11-208984 A 8/1999
JP 11-249346 A 9/1999
JP 2004142469 A * 5/2004

(Continued)

*Primary Examiner* — Judy Nguyen
*Assistant Examiner* — Quang X Nguyen
(74) *Attorney, Agent, or Firm* — Canon USA, Inc., IP Division

(57) ABSTRACT

A disabled state in which sheets cannot be discharged at a discharge unit while printing is detected. Upon detecting the disabled state, printing is continued at a printing unit, and a sheet printed upon is evacuated to a storage unit without cutting into a plurality of cut sheets at a cutter unit. After the disabled state is resolved, the sheet which has been evacuated to the storage unit is sent to the cutter unit so as to be cut into the cut sheets, and discharged at the discharge unit.

12 Claims, 9 Drawing Sheets

FOREIGN PATENT DOCUMENTS

| | | | | |
|---|---|---|---|---|
| JP | 2005-258251 | A | | 9/2005 |
| JP | 2007079597 | A | * | 3/2007 |
| JP | 2008-126530 | A | | 6/2008 |
| JP | 2009-278484 | A | | 11/2009 |

* cited by examiner

PRINTING APPARATUS AND CONTROL METHOD OF PRINTING APPARATUS

BACKGROUND OF THE INVENTION

1. Field of the Invention

The present invention relates to a printing apparatus which prints on a continuous sheet and cuts before discharging.

2. Description of the Related Art

With a printing apparatus capable of continuous printing of a great number of sheets, sheet conveying jamming (hereinafter simply referred to as "jamming") may occur within a sorter where sheets are sorted to multiple discharge trays. Once jamming occurs, all or part of various processing units upstream of the discharge trays have to be stopped, which has great negative impact, such as subsequent jobs being stopped, and so forth.

The printing apparatus disclosed in Japanese Patent Laid-Open No. 11-208984 has a function of sorting sheets to multiple discharge trays (discharge bins) in a sorter. In the event that jamming occurs in the sorter while performing consecutive printing, a sheet conveyance path is switched over, so as to discharge sheets to a tray other than the discharge tray which has become unavailable for use. Accordingly, even if jamming does occur, the probability of subsequent jobs stopping is reduced.

With the device in Japanese Patent Laid-Open No. 11-208984, there are cases that some sort of trouble occurs at the discharge unit at the time of performing continuous printing, and printed articles cannot be accepted any more. For example, in the event that jamming occurs at the sorter, only discharge trays upstream from the position where the jamming has occurred can be used. The further upstream within the sorter the position where the jamming has occurred is, the greater the restriction is on the number of sheets which can be accepted, since the number of discharge trays which are available is reduced. In the event that the discharge tray most upstream becomes unavailable, acceptance of sheets becomes completely unavailable.

As for another example of trouble, even if no jamming occurs, if the device is run for a long time with no user attending to it, and accordingly the printed articles are not removed from the discharge trays for a long period of time, all discharge trays will become full of printed articles. If such a state continues, there will be no destination available for the printed articles, so the device has to be shut down immediately.

SUMMARY OF THE INVENTION

One of the aspects of the present invention has been made in light of the above problems with conventional arrangements. The one of the aspects of the present invention provides for a method to suppress stopping of printing operations even in the event that trouble has occurred at the discharge unit during continuous printing and printed article cannot be accepted anymore, thereby suppressing deterioration in printing productivity.

According to an aspect of the present invention, an apparatus capable of duplex printing includes: a sheet feeding unit configured to feed a sheet wherein the sheet is continuous; a print unit configured to perform printing on the sheet fed from the sheet feeding unit; a cutter unit capable of cutting the sheet, which has been printed by the print unit, into a plurality of cut sheets; a discharge unit configured to discharge the cut sheets; a reverse unit configured to temporarily store the sheet for reversing and feeding the reversed sheet to the printing unit again; a detecting unit configured to detect a disabled state in which sheets cannot be discharged at the discharge unit; and a control unit, wherein upon the disabled state being detected by the detecting unit while printing, the control unit controls to continue printing at the printing unit, and evacuate the sheet printed to the reverse unit for temporarily storing, without cutting into the cut sheets, and wherein after the disabled state is resolved, the control unit controls to send the sheet, which has been evacuated to the reverse unit, to the cutter unit so as to be cut into the cut sheets, and to discharge the cut sheets at the discharge unit.

According to one of the aspects of the present invention, stopping of printing operations can be suppressed even in the event that trouble has occurred at the discharge unit during continuous printing and printed article cannot be accepted anymore, and deterioration in printing productivity can be suppressed.

Further features of the present invention will become apparent from the following description of exemplary embodiments with reference to the attached drawings.

DESCRIPTION OF THE EMBODIMENTS

Hereafter, embodiments of a printing apparatus using the inkjet method will be described. The printing apparatus of the present embodiment is a high-speed line printer which can handle both of simplex printing and duplex printing using a long continuous sheet (long continuous sheet longer than the length of repetition print units (also called one page or unit image) in the conveying direction). For example, this printing apparatus is adapted to a field for printing a great number of sheets in a print lab or the like. Note that, with the present Specification, even when multiple small images, letters, or blanks are mixed in a one print unit (one page) region, all included in this region are referred to as one unit image. That is to say, a unit image means one print unit (one page) in the event of successively printing multiple pages on a continuous sheet. The length of a unit image differs according to an image size to be printed. For example, with a photo of L size, the length in the sheet conveying direction is 135 mm, and with A4 size, the length in the sheet conveying direction is 297 mm.

The present invention may widely be applied to a printing apparatus such as a printer, a multi-function printer, a copying machine, a facsimile apparatus, a manufacturing device of various types of device, and so forth. The print processing is not restricted to any method, and may be the inkjet method, electrophotography method, thermal transfer method, dot-impact method, liquid development method, or the like.

Figure 1:
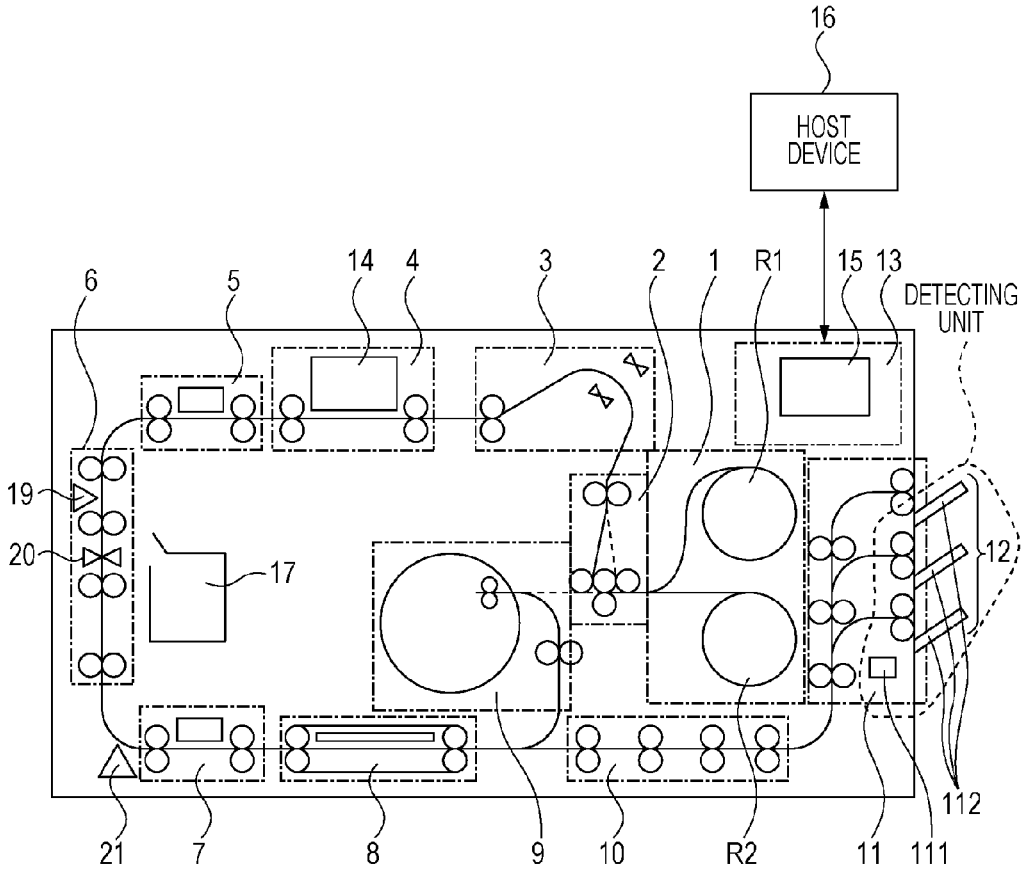
FIG. 1 is a schematic diagram illustrating the inner configuration of a printing apparatus.

FIG. 1 is a schematic view illustrating the internal configuration of the printing apparatus. The printing apparatus according to the present embodiment is capable of using a sheet wound in a rolled state to perform duplex printing on a first surface of the sheet and a second surface on the back surface side of the first surface. The printing apparatus principally includes each unit of a sheet feeding unit 1, a decurling unit 2, a skew correcting unit 3, a print unit 4, an inspection unit 5, a cutter unit 6, an information recording unit 7, a drying unit 8, a reverse unit 9, a discharge conveying unit 10, a sorter unit 11, a discharge unit 12, and a control unit 13. The discharge unit 12 refers to a unit which includes the sorter unit 11 and performs discharge processing. The sheet is conveyed by a conveying mechanism made up of a roller pair and a belt and so forth along a sheet conveying path indicated with a solid line in the drawing, and is processed at each unit. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The sheet feeding unit 1 is a unit for holding and feeding a continuous sheet wound in a rolled state. The sheet feeding unit 1 is capable of housing two rolls R1 and R2, and has a configuration for alternatively paying out sheets to be fed. Note that the number of rolls to be housed is not restricted to two, and one or three or more may be housed. Also, the sheets are not restricted to being wound on rolls as long as they are continuous. For example, an arrangement may be made wherein a continuous sheet is provided with perforated lines every unit length, and folded back and forth to be layered and stacked in the sheet feeding unit 1.

The decurling unit 2 is a unit for reducing curling (warping) of the sheet fed from the sheet feeding unit 1. With the decurling unit 2, curling is reduced by decurling force being influenced by passing through the sheet in a bent manner so as to provide warping in the opposite direction using two pinch rollers as to one driving roller.

The skew correcting unit 3 is a unit for correcting skewing of the sheet having passed through the decurling unit 2 (angle as to the true direction of travel). The inclination of the sheet is corrected by pressing a sheet edge portion on the side serving as a reference against a guide member.

The print unit 4 is a sheet processing unit for subjecting a sheet to be conveyed to print processing by a print head 14 from above to form an image. The print unit 4 also includes multiple conveying rollers to convey a sheet. The print head 14 includes a line-type print head where a nozzle train of the inkjet method is formed in a range covering the maximum width of a sheet to be used. With the print head 14, multiple print heads are arrayed in parallel along the conveying direction. With the present example, the print head 14 includes seven print heads corresponding to seven colors of C (cyan), M (magenta), Y (yellow), LC (light cyan), LM (light magenta), G (gray), and K (black). Note that the number of colors, and the number of print heads are not restricted to seven. As for the inkjet method, there may be employed a method using a heater element, a method using a piezoelectric element, a method using an electrostatic device, a method using an MEMS element, or the like. The ink of each color is supplied to the print head 14 via the corresponding ink tube from an ink tank.

The inspection unit 5 is a unit for optically scanning a test pattern or image printed on a sheet at the print unit 4 by a scanner to determine whether the image has correctly been printed by inspecting the states of the nozzles of the print head, sheet conveying state, image position, and so forth. The scanner includes a CCD image sensor or CMOS image sensor.

The cutter unit 6 is a unit including a mechanical cutter 20 for cutting a sheet after printing into a predetermined length. The cutter unit 6 also includes a cut mark sensor 19 for optically detecting cut marks recorded on the sheet, and multiple conveying rollers for feeding out the sheet to the next process. A trash box 17 is provided near the cutter unit 6. The trash box 17 is for containing small sheet scraps discharged as trash, having been cut off at the cutter unit 6. The cutter unit 6 has a sorting function for discharging cut sheets to the trash box 17 or conveying to the intended conveyance path.

The information recording unit 7 is a unit for recording print information (unique information) in a non-print region of the cut sheet, such as the serial number or date or the like of printing. Recording is performed by printing characters or code by the inkjet method or thermal transfer method or the like. A sensor 21 for detecting the leading edge of the cut sheet is provided to the upstream side of the information recording unit 7 and the downstream side of the cutter unit 6. That is to say, timing for recording information at the information recording unit 7 is controlled based on the detection timing of the sensor 21 which detects the edge portion of a sheet between the cutter unit 6 and the recorded position by the information recording unit 7.

The drying unit 8 is a unit for heating the sheet printed by the print unit 4 to dry the applied ink in a short period of time. The sheet to be passed through is applied with heated air from at least the lower surface side to dry the ink applied surface within the drying unit 8. Note that the drying method is not restricted to the method for applying heated air, and may be a method for irradiating electromagnetic waves (such as an ultraviolet ray, infrared ray, or the like) on the sheet front surface.

The above sheet conveying path from the sheet feeding unit 1 to the drying unit 8 will be referred to as a first path. The first path has a shape which performs a U-turn between the print unit 4 and the drying unit 8, and the cutter unit 6 is positioned in the middle of the U-turn shape.

The reverse unit 9 is a unit for temporarily winding the continuous sheet of which the front surface printing has been completed thereupon to reverse both sides at the time of performing duplex printing. The reverse unit 9 is provided in the middle of a path (loop path) (referred to as "second path") from the drying unit 8 to the print unit 4 via the decurling unit 2 for feeding the sheet passed through the dying unit 8 to the print unit 4 again. The reverse unit 9 includes a winding rotary member (drum) which rotates for winding the sheet thereupon. The continuous sheet of which the printing of front surface has been completed has not been cut is temporarily wound around the winding rotary member. At the time of winding being completed, the winding rotary member rotates in an opposite direction, the sheet wound thereupon is fed out in the reverse order at the time of winding around the decurling unit 2, and is fed to the print unit 4. Both sides of this sheet have been reversed, so the back surface can be printed at the print unit 4. More specific operation of duplex printing will be described later.

The discharge conveying unit 10 is a unit for conveying the sheet cut at the cutter unit 6 and dried at the drying unit 8 to transfer the sheet to the sorter unit 11. The discharge conveying unit 10 is provided to a path different from the second path where the reverse unit 9 is provided (referred to as "third path"). In order to selectively guide the sheet conveyed in the first path into any one of the second path and third path, a path switching mechanism having a movable flapper is provided to a branching position of the paths (hereafter referred to as "discharge branching position").

The discharge unit 12 including the sorter unit 11 is provided to the side portion of the sheet feeding unit 1 and also the tail end of the third path. The sorter unit 11 is a unit for classifying the printed sheet for each group as appropriate. The classified sheet is discharged to the discharge unit 12 made up of multiple trays. In this way, the third path has a layout where the sheet is passed through the lower side of the sheet feeding unit 1 and is discharged to the opposite side of the print unit 4 and the drying unit 8 sandwiching the sheet feeding unit 1.

As described above, the sheet feeding unit 1 through the drying unit 8 are provided to the first path in order. The end of the drying unit 8 is branched into the second path and the third path, the reverse unit 9 is provided in the middle of the second path, and the end of the reverse unit 9 joins the first path. The discharge unit 12 is provided to the tail end of the third path.

The control unit 13 is a unit which manages control of each unit of the whole printing apparatus. The control unit 13 includes a CPU, a storage device, a controller including various types of control unit, an external interface, and an operation unit 15 by which a user performs input/output. The operation of the printing apparatus is controlled based on the command from a host device 16 such as a host computer to be connected to the controller directly or via the external interface.

Figure 2:
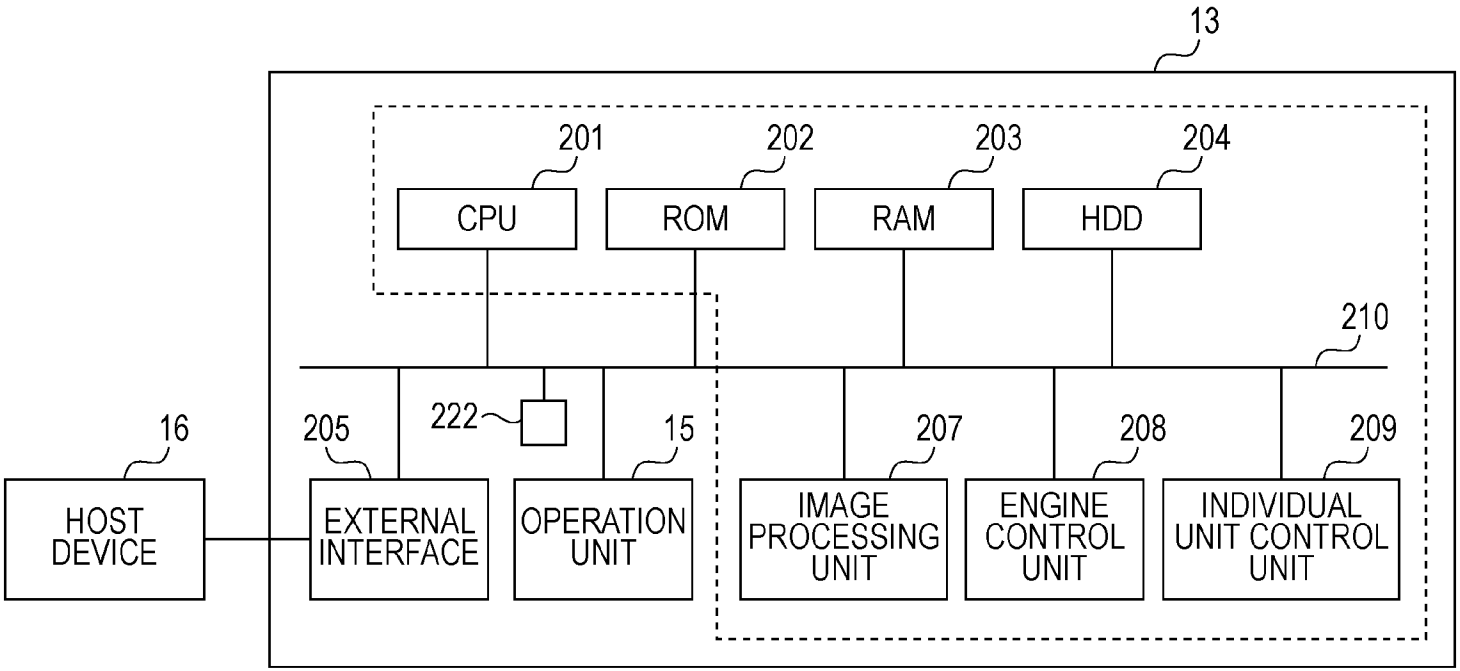
FIG. 2 is a block diagram of a control unit.

FIG. 2 is a block diagram illustrating the concept of the control unit 13. The controller included in the control unit 13 (range surrounded with a dashed line) is configured of a CPU 201, ROM 202, RAM 203, an HDD 204, an image processing unit 207, an engine control unit 208, and an individual unit control unit 209. The CPU 201 (central processing unit) centrally controls the operation of each unit of the printing apparatus. The ROM 202 stores a program to be executed by the CPU 201, and fixed data to be used for various types of operation of the printing apparatus. The RAM 203 is used as the work area of the CPU 201, or used as a temporarily storage region of various types of reception data, or used for storing various types of setting data. The HDD 204 (hard disk) can store or read out a program to be executed by the CPU 201, print data, and setting information used for various types of operation of the printing apparatus. The operation unit 15 is an input/output interface with the user, and includes an input unit such as a hard key or touch panel, and an output unit such as a display for presenting information, an audio generator, or the like.

A dedicated processing unit is provided regarding a unit which requires high-speed data processing. The image processing unit 207 performs the image processing of print data to be handled at the printing apparatus. The image processing unit 207 converts the color space of the input image data (e.g., YCbCr) into standard RGB color space (e.g., sRGB). Also, the image data is subjected to various types of image processing such as resolution conversion, image analysis, image correction, or the like as appropriate. The print data obtained by these image processes is stored in the RAM 203 or HDD 204. The engine control unit 208 performs driving control of the print head 14 of the print unit 4 according to the print data based on the control command received from the CPU 201 or the like. The engine control unit 208 further performs control of the conveying mechanism of each unit within the printing apparatus. The individual unit control unit 209 is a sub controller for individually controlling each unit of the sheet feeding unit 1, decurling unit 2, skew correcting unit 3, inspection unit 5, cutter unit 6, information recording unit 7, drying unit 8, reverse unit 9, discharge conveying unit 10, sorter unit 11, and discharge unit 12. The operation of each unit is controlled by the individual unit control unit 209 based on the command by the CPU 201. The external interface 205 is an interface for connecting the controller to the host device 16, and is a local interface or network interface. The above components are connected by a system bus 210.

The host device 16 is a device serving as the supply source of image data for causing the printing apparatus to perform printing. The host device 16 may be a general-purpose or dedicated computer, or may be dedicated image equipment such as an image capture having an image reader unit, a digital camera, photo storage, or the like. In the event that the host device 16 is a computer, OS, application software for generating image data, and a printer driver for printing apparatus are installed into a storage device included in the computer. Note that it is not essential that all of the above processes are realized by software, so part or all may be realized by hardware.

Next, basic operation at the time of printing will be described. With printing, the operation differs depending on the simplex print mode or the duplex print mode, so each will be described.

Figure 3A:
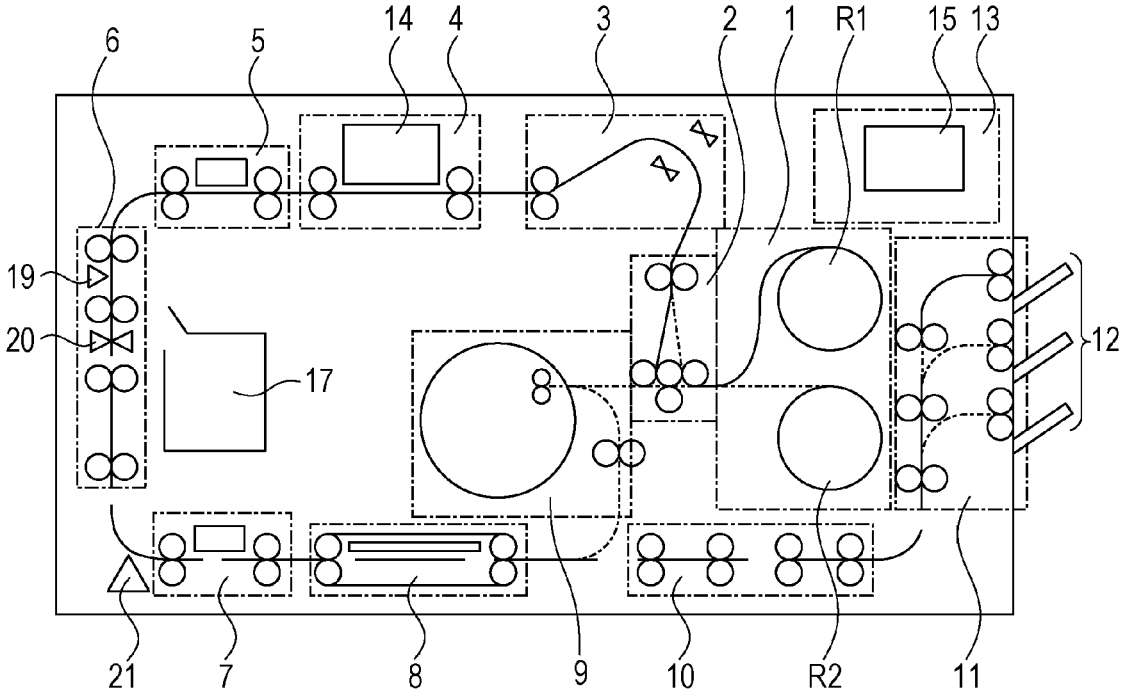
FIGS. 3A and 3B are diagrams for describing operations in a simplex printing mode and a duplex printing mode.

FIG. 3A is a diagram for describing the operation in the simplex print mode. With the sheet fed from the sheet feeding unit 1, and processed at each of the decurling unit 2 and skew correcting unit 3, printing of the front surface (first surface) is performed at the print unit 4. The image (unit image) of a predetermined unit length in the conveying direction is sequentially printed to array the multiple images as to the long continuous sheet. The printed sheet is cut for each unit image at the cutter unit 6 via the inspection unit 5. With the cut sheets, print information is recorded on the back surfaces of the sheets by the information recording unit 7 as appropriate. The cut sheets are conveyed to the drying unit 8 one sheet at a time, and are dried. Subsequently, the cut sheets are sequentially discharged to the discharge unit 12 of the sorter unit 11 via the discharge conveying unit 10, and are loaded. On the other hand, the sheets left behind to the print unit 4 side at the time of cutting of the last unit image is fed back to the sheet feeding unit 1, and the sheets are wound around the rolls R1 and R2.

In this way, with simplex printing, the sheet is passed through the first path and the third path and is processed, but is not passed through the second path. If the above is summarized, with the simplex print mode, the following (1) through (6) sequence is executed by the control of the control unit 13.

(1) Feed out the sheet from the sheet feeding unit 1 to feed to the print unit 4.
(2) Repeat printing of a unit image on the first surface of the fed sheet at the print unit 4.
(3) Repeat cutting of the sheet at the cutter unit 6 for each unit image printed on the first surface.
(4) Pass the sheet cut for each unit image through the drying unit 8 one sheet at a time.
(5) Discharge the sheet passed through the drying unit 8 to the discharge unit 12 through the third path one sheet at a time.
(6) Feed the sheet left behind to the print unit 4 side by the last unit image being cut, back to the sheet feeding unit 1.

Figure 3B:
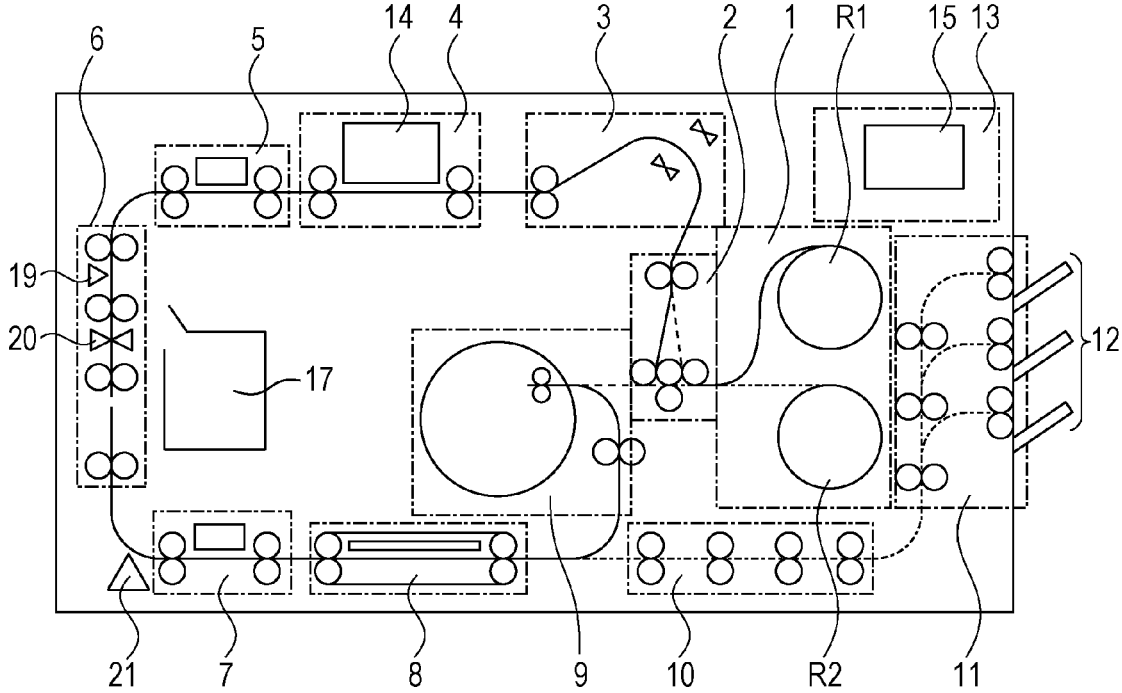

FIG. 3B is a diagram for describing the operation in the duplex print mode. With duplex printing, back surface (second surface) print sequence is executed following the front surface (first surface) print sequence. With the first front surface print sequence, the operation at each unit from the sheet feeding unit 1 to the inspection unit 5 is the same as the operation of the above simplex printing. Cutting operation is not performed at the cutter unit 6, and the sheet is conveyed to the drying unit 8 still in the continuous sheet form. After ink drying of the front surface at the drying unit 8, the sheet is guided not to the path on the discharge conveying unit 10 (third path) but to the path on the reverse unit 9 side (second path). With the second path, the sheet is wound around the winding rotary member of the reverse unit 9 which rotates in the forward direction (counter clockwise direction in the drawing). After the scheduled front surface printing is all completed at the print unit 4, the trailing edge of the print region of the continuous sheet is cut at the cutter unit 6. The continuous sheet on the conveying direction downstream side (printed side) is all wound around up to the sheet trailing edge (cut position) at the reverse unit 9 through the drying unit 8 with the cut position as a reference. On the other hand, the continuous sheet left behind on the conveying direction upstream side (print unit 4 side) of the cut position is wound back to the sheet feeding unit 1 so that the sheet leading edge (cut position) is not left behind at the decurling unit 2, and the sheet is wound around the rolls R1 and R2. Collision with the sheet to be fed again in the following back surface print sequence is avoided according to this winding back.

After the above front surface print sequence, the front surface print sequence is switched to the back surface print sequence. The winding rotary member of the reverse unit 9 rotates in the opposite direction (clockwise direction in the drawing) of the direction at the time of being wound thereupon. The edge portion of the sheet wound around (the sheet trailing edge at the time of being wound thereupon becomes the sheet leading edge at the time of being fed back) is fed to the decurling unit 2 along the path indicated with a dashed line in the drawing. Correction of curling applied by the winding rotary member is performed at the decurling unit 2. That is to say, the decurling unit 2 is a common unit which serves decurling in either path, provided between the sheet feeding unit 1 and the print unit 4 in the first path, and provided between the reverse unit 9 and the print unit 4 in the second path. The sheet of which both sides are inverted is fed to the print unit 4 via the skew correcting unit 3, where printing on the back surface of the sheet is performed. The printed sheet is fed to the cutter unit 6 via the inspection unit 5, and is cut at the cutter unit 6 for each predetermined unit length. With the cut sheet, both sides are printed, so recording at the information recording unit 7 is not performed. The cut sheet is conveyed to the drying unit 8 one sheet at a time, and is sequentially discharged and loaded in the discharge unit 12 of the sorter unit 11 via the discharge conveying unit 10.

In this way, with duplex printing, the sheet is processing passing through the first path, second path, first path, and third path in this order. If the above is summarized, with the duplex print mode, the following (1) through (11) sequence is executed by the control of the control unit 13.

(1) Feed out the sheet from the sheet feeding unit 1 to feed to the print unit 4.
(2) Repeat printing of a unit image on the first surface of the fed sheet at the print unit 4.
(3) Pass the sheet of which the first surface is printed, through the drying unit 8.
(4) Lead the sheet passed through the drying unit 8 into the second path to wind the sheet around the winding rotary member included in the reverse unit 9.
(5) Cut the sheet at the cutter unit 6 at the end of the last printed unit image after repetition of printing as to the first surface.
(6) Wind the cut sheet around the winding rotary member until the edge portion of the cut sheet passes through the drying unit 8 and reaches the winding rotary member. Also feed the sheet cut and left behind to the print unit 4 side, back to the sheet feeding unit 1.
(7) Rotate the winding rotary member in an opposite direction after winding the sheet thereupon, and feed the sheet to the print unit 4 from the second path again.
(8) Repeat printing of a unit image on the second surface of the sheet fed from the second path at the print unit 4.
(9) Repeat cutting of the sheet at the cutter unit 6 for each unit image printed on the second surface.
(10) Pass the sheet cut for each unit image through the drying unit 8 one sheet at a time.
(11) Discharge the sheet passed through the drying unit 8 to the discharge unit 12 through the third path one sheet at a time.

Next, a technique for suppressing stopping of printing operations as much as possible with the printing apparatus of the above-described configuration, even in a case where trouble has occurred at the discharge unit 12 including the sorter unit 11 and printed articles cannot be accepted, will be described in further detail.

Several terms will be described for this description. A state wherein discharging of sheets cannot be made to the discharge unit 12, due to jamming occurring at the sorter unit 11 or discharge trays of the discharge unit 12, or all of multiple trays begin full or nearly full, will be referred to as a "disabled state". For example, a state wherein the total available capacity of all available trays is zero sheets to a few sheets (less than a predetermined number determined by the length of the sheet conveying path from the cutter unit 6 to the discharge unit 12), is a "disabled state". That is to say, a "disabled state" includes a state immediately before the available capacity of the tray reaching zero, with hardly any leeway anymore. Also, consecutively conveying multiple cut sheets (a number where the total length of the multiple sheets is longer than at least the third path) so as to be discharged from the discharge unit 12 will be referred to as "consecutive discharging". This term does not refer to performing discharging processing for just a short time. Once a "disabled state" is reached, "consecutive discharging" cannot be performed.

Figure 4:
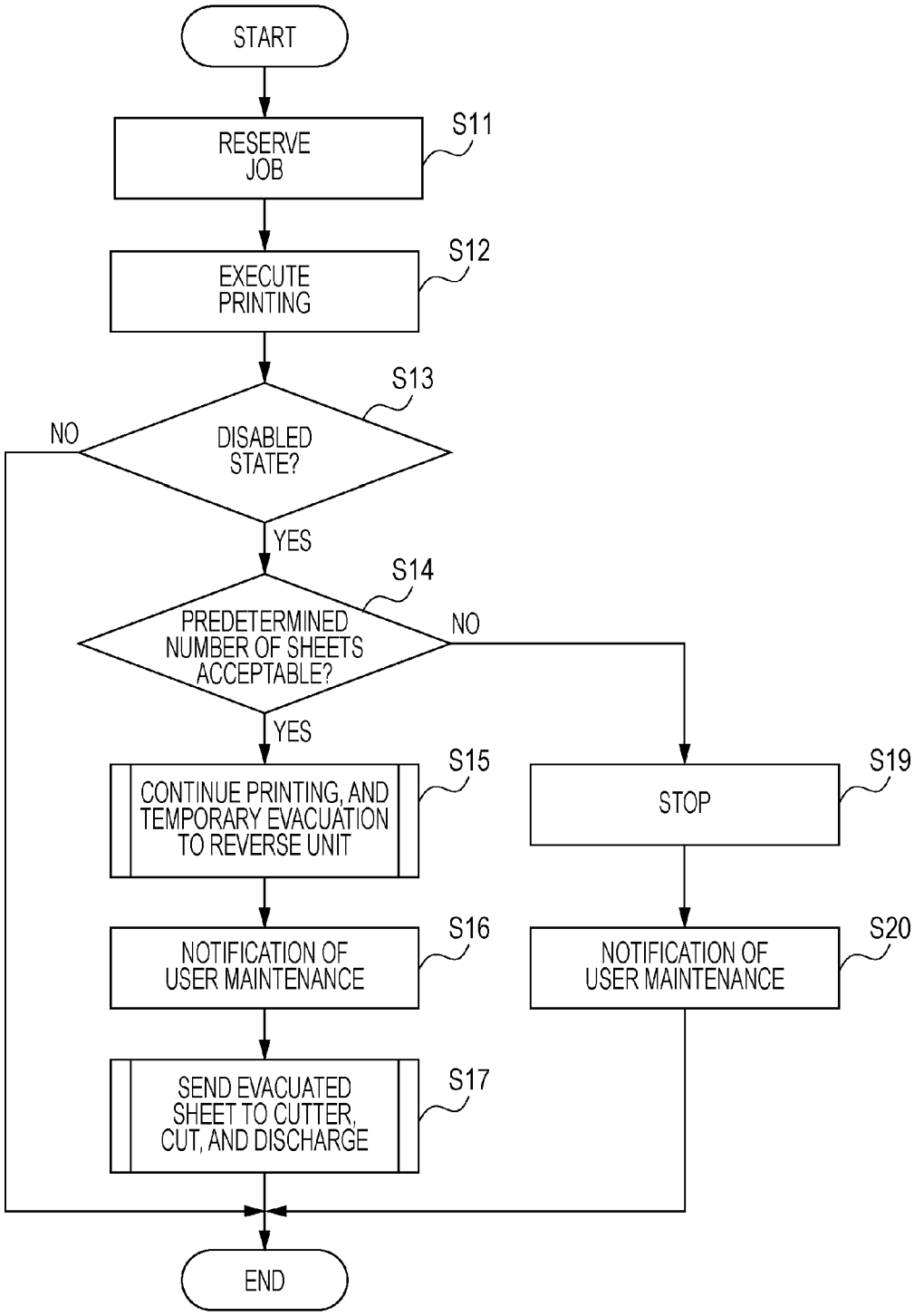
FIG. 4 is a flowchart illustrating a processing sequence at the time of trouble occurring at the discharge unit.

FIG. 4 is a flowchart illustrating a processing sequence for when trouble has occurred at the discharge unit. In step S11, reservations for multiple consecutive print jobs (regardless of simplex printing mode or duplex printing mode) are accepted from host devices and the like. The print image data and the like corresponding to the accepted jobs is stored in a storage unit (RAM 203 or HDD 204) of the control unit 13.

In step 12, printing of the print jobs regarding which reservations have been made is performed according to the above-described procedures.

In step S13, a "disabled state" is detected while printing. Here, occurrence of jamming at the discharge unit 12 including the sorter unit 11, and all trays being almost full, is detected. Occurrence of jamming is detected by detecting jamming of sheets with multiple jamming sensors provided in the sorter. Also, the remaining capacity of the trays is detected with tray sensors provided to the trays. Upon the user removing the sheets loaded on the tray, the sensor detects this and the amount loaded on the tray is reset to zero. That is to say, the jamming sensors 111, tray sensors 112, and the signal processing of these detection signals make up a "disabled state" detecting unit. In the event that printing of the scheduled jobs is advanced and a "disabled state" is not reached before all printing is completed, the determination in step S13 is NO, and the printing sequence ends. On the other hand, in the event that the detecting unit detects a "disabled state" while printing (determination of YES), the flow advances to step S14.

In step S14, determination is made regarding whether or not cut sheets, downstream of the cutter unit 6 (sheets already cut in unit images) at the point that the "disabled state" has been detected, can be sent to the discharge unit 12 side of the discharge branching position. In other words, determination is made regarding whether or not a tray can accept the number of cut sheets remaining upstream of the discharge branching position. In the event that there is available space for a predetermined number of sheets, corresponding to the length of the sheet conveyance path from the cutting position of the cutting unit to the discharge branching position, the determination in step S14 is YES. In the event that jamming has occurred, if another tray to be used instead has available room for the predetermined number of sheets, the determination in step S14 is YES. In the event that a determination of YES is made in step S14, the flow advances to step S15, and in the event that the determination is NO, the flow goes to step S19.

In step S19, all sheet conveyance relating to printing operations is stopped. In step S20, the state of the trouble at the discharge unit 12 (jamming position, or all trays full) is displayed at the display unit of the operation unit 15, prompting the user to perform maintenance.

In step S15, printing of the remaining jobs is continued at the printing unit even after the "disabled state" is detected, and the sheets continuously printed are not cut in to unit images at the cutter unit 6 but are wound onto the reverse unit 9 and thus evacuated. Details will be described later.

In parallel with this processing, in step S16 the state of the trouble at the discharge unit 12 (jamming position, or all trays full) is displayed at the display unit of the operation unit 15, prompting the user to perform maintenance. Even while the user is performing maintenance of the discharge unit 12 including the sorter 11, part of the printing processing in step S15 is continuing. The user only has to access the discharge unit including the sorter of the printing apparatus, and does not need to access any of the units further upstream, so the printing operations can be performed parallel to the maintenance work.

In step S17, following the "disabled state" being resolved by maintenance work performed by the user, the sheets evacuated to the reverse unit 9 are sent to the cutter unit 6 again and cut into unit images, and the completed printed articles are discharged to the discharge unit 12. Details will be described later.

Figure 5:
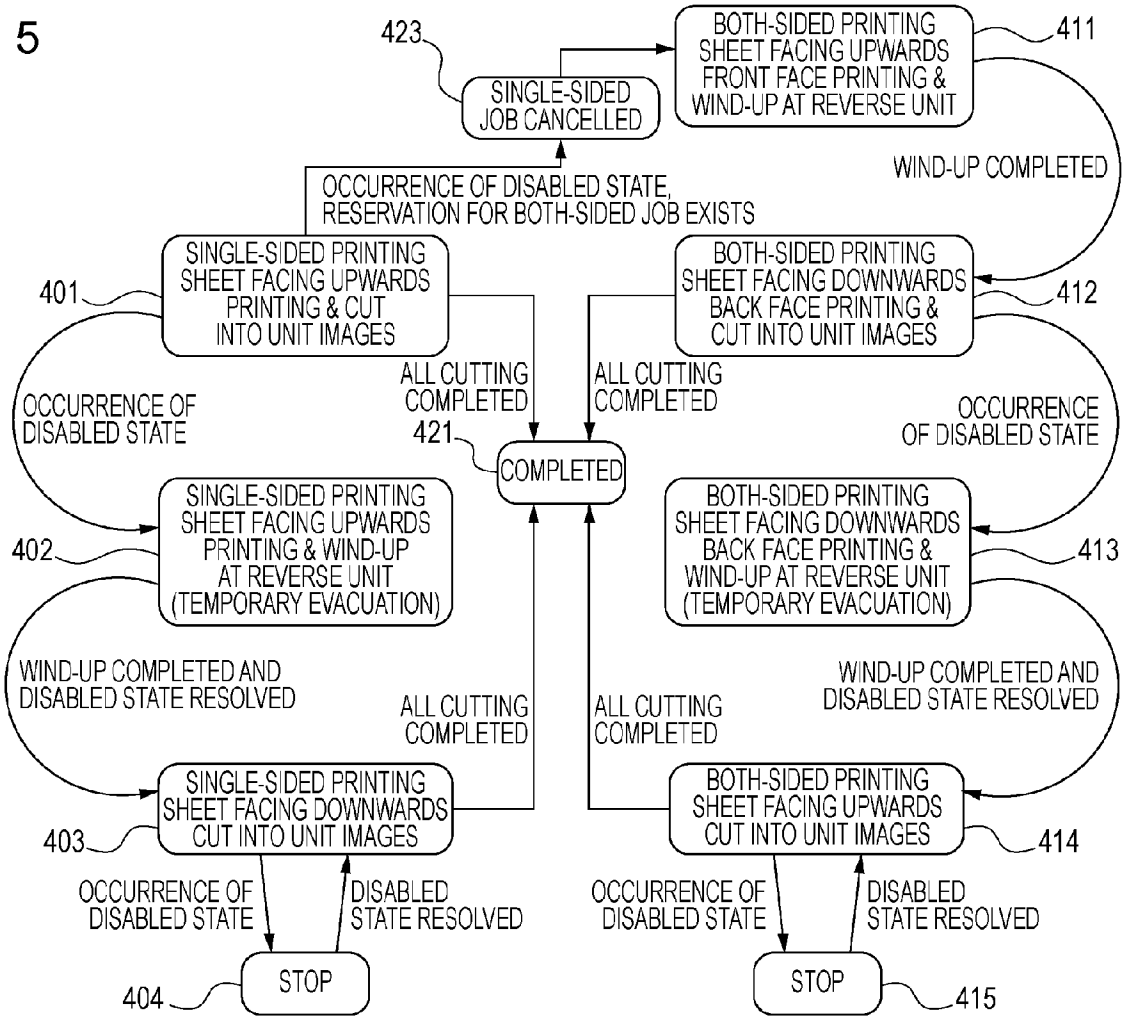
FIG. 5 is a diagram for describing state transition in the event that a "disabled state" occurs.

FIG. 5 is a diagram for describing state transition in a case that a "disabled state" has occurred during printing operations with the printing apparatus according to the present embodiment. In this drawing, the term "cut" indicates a state wherein sheets have been cut by the cutter unit 6 and have been sent downstream of the discharge branching position. "Wind-up" indicates a state wherein cutting into unit images by the cutter has been stopped and the continuous sheet is being wound onto the reverse unit 9. The procedures for recovery from a "disabled state" depend on the timing at which the "disabled state" has occurred. These are the following seven cases, including a case wherein the "disabled state" does not occur.

(1) A normal case wherein, in the simplex printing mode, printing is completed without a "disabled state" ever occurring.

Transition is made in the order of state 401 and state 421. State 401 is the default state for the simplex printing mode, and if cutting of all sheets is completed with no "disabled state" occurring, the processing ends that way (state 421).

(2) A normal case wherein, in the duplex printing mode, printing is completed for both the front and back surfaces without a "disabled state" ever occurring.

Transition is made in the order of state 411, state 412, and state 421. State 411 is the default state for the duplex printing mode, and next transition is made to state 412 (back surface printing). If cutting of all sheets is completed with no "disabled state" occurring, the processing ends that way (state 421).

(3-1) A case wherein a "disabled state" occurs in the simplex printing mode.

Transition is made in the order of state 401, state 402, state 403, and state 421. Details will be described later.

(3-2) A case wherein a "disabled state" is detected in the simplex printing mode, with a duplex job having been reserved following the simplex printing job.

The simplex printing job is cancelled and switched to the duplex printing mode. Transition is made in the order of state 401, state 411, state 412, and state 421. Details will be described later.

(4) A case wherein a "disabled state" occurs in the duplex printing mode, while printing the back surface.

Transition is made in the order of state 411, state 412, state 413, state 414, and state 421. Details will be described later. Note that a "disabled state" will not occur in the duplex printing mode while printing the front surface, since the sheets are not discharged to the discharge unit 12 at this time.

(5) A case wherein a "disabled state" occurs in the simplex printing mode, while cutting into unit images at the cutter unit 6.

Transition is made in the order of state 403 and state 404. The reason that the device is stopped in the event of a "disabled state" is that all printing has already ended, and there is nothing to be temporarily evacuated. After resolving the "disabled state", the state returns to state 403.

(6) A case wherein a "disabled state" occurs in the duplex printing mode, while cutting into unit images at the cutter unit 6.

Transition is made in the order of state 414 and state 415. The reason that the device is stopped in the event of a "disabled state" is that all printing has already ended, and there is nothing to be temporarily evacuated. After resolving the "disabled state", the state returns to state 414.

While we are considering printing processing here, the same holds for processing that goes with the printing (inspection, recording of information, drying, etc.), with necessary processing being continued even after a "disabled state" occurs.

Next, the processing in step S15 in the flowchart in FIG. 4 will be described with reference to the flowcharts in FIGS. 6 through 8. This sequence is executed in three of the above-described cases, namely (3-1), (4), and (3-2). These will be described in order.

Figure 6:
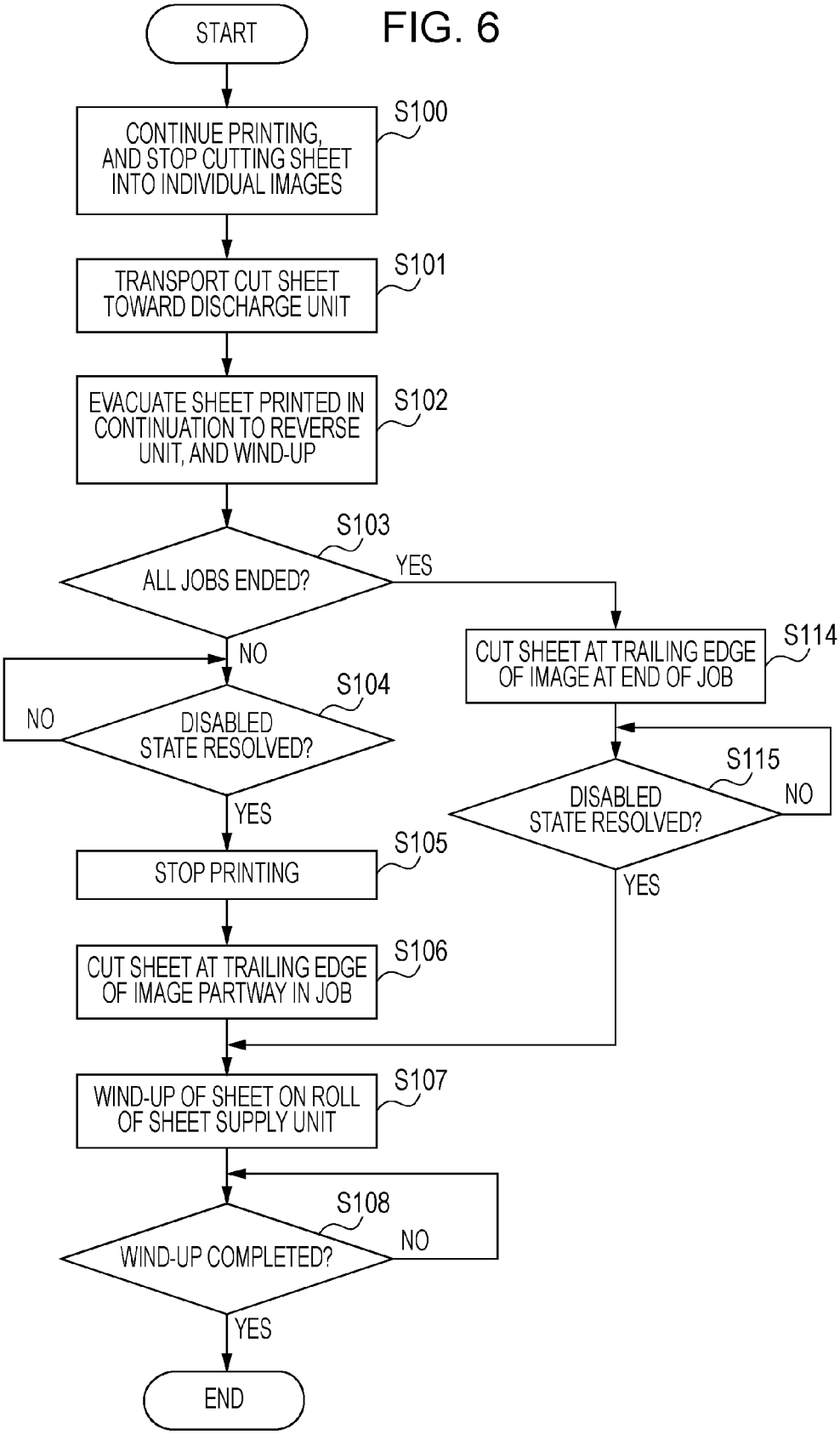
FIG. 6 is a flowchart illustrating processing in the event that a "disabled state" has been detected during printing.

FIG. 6 is processing for a case of a "disabled state" being detected in the simplex printing mode. This corresponds to the case of (3-1) described above.

In step S100, even in the "disabled state", printing of the job continues at the print unit 4, while cutting into unit images of the printed sheets regarding which printing is continuing is stopped at the cutter unit 6.

In step S101, the cut sheets which have already been cut into unit images at the cutter unit 6 and are on the path downstream of the cutting position are conveyed to the path at the side of the discharge unit 12 (third path) and sent out. The state is the "disabled state", so all cut sheets on the path downstream of the cutting position may not be able to be discharged to the discharge unit 12. However, the determination of step S14 described above has already been made, so at least the cut sheets on the path from the cutter unit 6 to the discharge branching position will be removed from the path.

In the event that discharge cannot be performed in a state with cut sheets remaining on the path downstream of the discharge branching position, the cut sheets can be left on the path and then later sent to the discharge unit 12 after the "disabled state" is resolved.

Sheets regarding which multiple images are printed on the first surface in step S100 following after the moving cut sheets are not cut, and pass through the cutter unit 6, information recording unit 7, and drying unit 8, as a continuous sheet without being cut. The continuous sheet is then conveyed to the path at the reverse unit 9 side (second path), rather than the third path.

Note that the timing for stopping sheet cutting into unit images does not necessarily have to be immediately after the "disabled state" has been detected. It is sufficient to stop cutting at a timing within a range where cut sheets upstream of the discharge branching position to be sent out from the discharge unit 12 side of the discharge branching position.

In step S102, the printed continuous sheet obtained by continuing the printing at step S100 is wound onto the winding rotary member, and is temporarily evacuated.

In step S103, determination is made regarding whether or not all printing of the simple print mode job being executed has been completed. In the event that the determination is NO (incomplete), the flow goes to step S104, and in the event that the determination is YES (complete), the flow goes to step S114.

In step S104, determination is made regarding whether or not the "disabled state" has been resolved, i.e., regarding whether or not the device is in a state capable of continuous discharging. In the event that the determination is YES the flow advances to step S105, and in the event that the determination is NO the flow returns to step S103.

In the case of having transitioned to step S105, discharge processing at the discharge unit 12 before ending of printing is available, so printing is stopped partway through the job.

In step S106, the sheet is cut at the trailing edge of the image at the timing of the image of the interrupted job printed last reaching the cutter unit 6. After step S106, the flow advances to step S107.

In the event that the flow has gone from step S103 to step S114, printing of the job has been completed before recovery of the sorter. In step S114, the sheet is cut at the trailing edge of the last-printed image of the job.

In step S115, the flow stands by for the user to perform maintenance and resolve the "disabled state". Once the determination becomes YES, the flow advances to step S107. At this time, the continuous sheet is cut at the cutter unit 6, and is divided into an upstream side and downstream side at the cut position thereof.

In step S107, the sheet (continuous sheet) upstream of the cutter unit 6 is returned to the sheet feeding unit 1 side, and round onto the roller of the sheet feeding unit 1.

In step S108, the flow stands by until winding of the sheet at the sheet feeding unit 1 ends and taking up of the sheet evacuated to the reverse unit 9 is completed, and once determination is made that these are completed (YES), the sequence ends.

Thus, the processing of step S15 in FIG. 4 is performed in a case where a "disabled state" has been detected while printing in the simplex mode.

Figure 7:
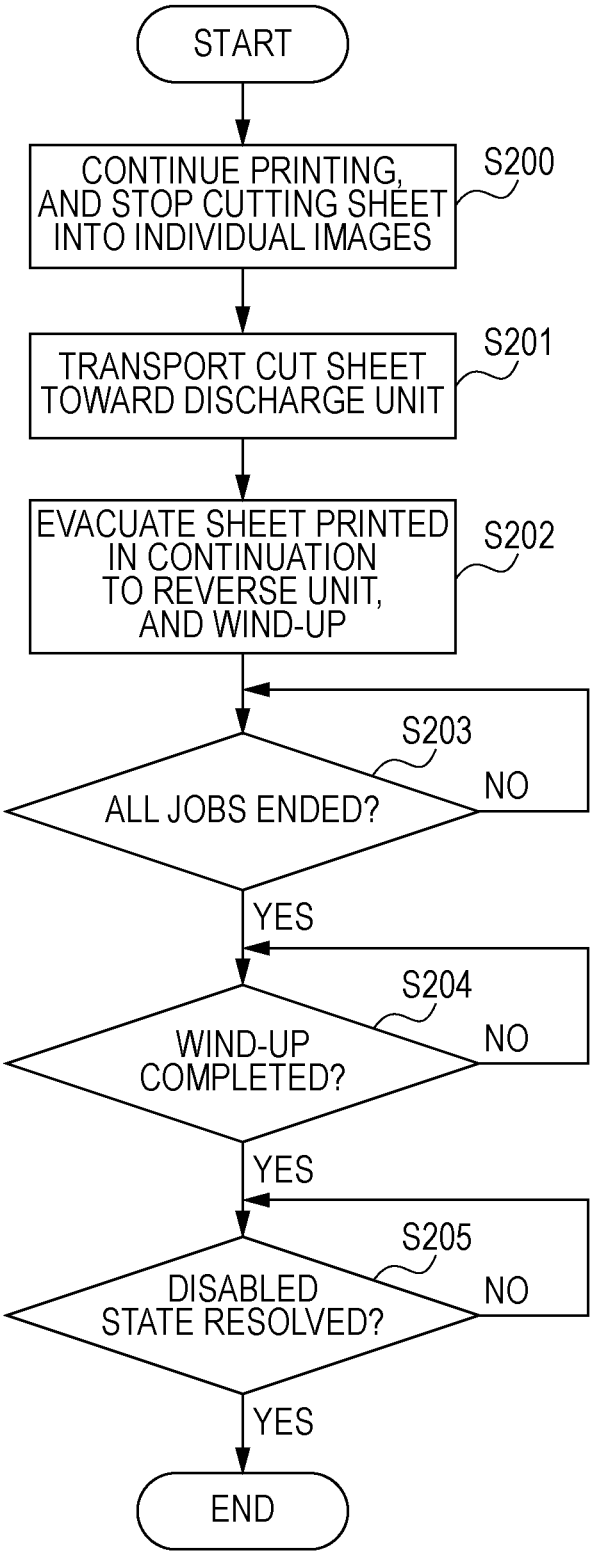
FIG. 7 is a flowchart illustrating processing in the event that a "disabled state" has been detected during printing.

FIG. 7 is processing for a case of a "disabled state" being detected while printing the back surface in the duplex printing mode. This corresponds to the case of (4) described above. In step S200, as with the case of step S100, printing of the job continues at the print unit 4, while cutting into unit images of the printed sheets regarding which printing is continuing is stopped at the cutter unit 6.

In step S201, the cut sheets which have already been cut into unit images at the cutter unit 6 and are on the path downstream of the cutting position are conveyed to the path at the side of the discharge unit 12 (third path) and sent out. Thus, cut sheets are removed from at least the path from the cutter unit 6 to the discharge branching position.

Sheets regarding which multiple images are printed on the first surface in step S100 following after the moving cut sheets are not cut, and pass through the cutter unit 6, information recording unit 7, and drying unit 8, as a continuous sheet. The continuous sheet is then conveyed to the path at the reverse unit 9 side (second path), rather than the third path.

In step S202, the printed continuous sheet obtained by continuing the printing at step S200 is wound onto the winding rotary member of the reverse unit 9, and is temporarily evacuated. In order to enable this operation, the duplex printing mode is carried out with a sheet length restricted so as to not exceed a predetermined length corresponding to the sheet conveyance path used for the duplex printing mode. This predetermined length is the length of the sheet conveyance path for a sheet sent out from the reverse unit 9 to pass through the print unit 4 and cutter unit 6 and be guided back to the reverse unit 9. The sheet length used in the duplex print mode is determined by calculating the total of the number of images to be printed on one surface of the sheet, the length of each image in the sheet conveyance direction, and the length of margin region between images. In the event that a separate print is to be made, such as a test print for maintenance, the length of the region to be used for that is also added into the calculation.

In step S203, the flow stands by until all printing of jobs on the back surface being executed ends. In the event that the judgment here is YES, the flow advances to step S204.

In step S204, the flow stands by until taking up of the sheet evacuated to the reverse unit 9 is completed, and in the event that the judgment here is YES, the flow advances to step S205.

In step S205, the flow stands by until the "disabled state" is resolved and continuous discharge is available. In the event that the judgment here is YES, the sequence ends.

Thus, processing of step S15 in FIG. 4 is performed in a case of a "disabled state" being detected while printing the back surface in the duplex printing mode. In the event that improved throughput is desired for the printing apparatus, the length of the sheet used for duplex printing should not be restricted by the above-described predetermined length, and should be made as long as possible. In this case, the sheet cannot be temporarily evacuated to the reverse unit 9, so in the event that a "disabled state" is detected while printing the back surface, this sequence is not run; rather, the printing operation is stopped and a notification is made by notification unit 222 (FIG. 2) to prompt the user to perform maintenance.

Figure 8:
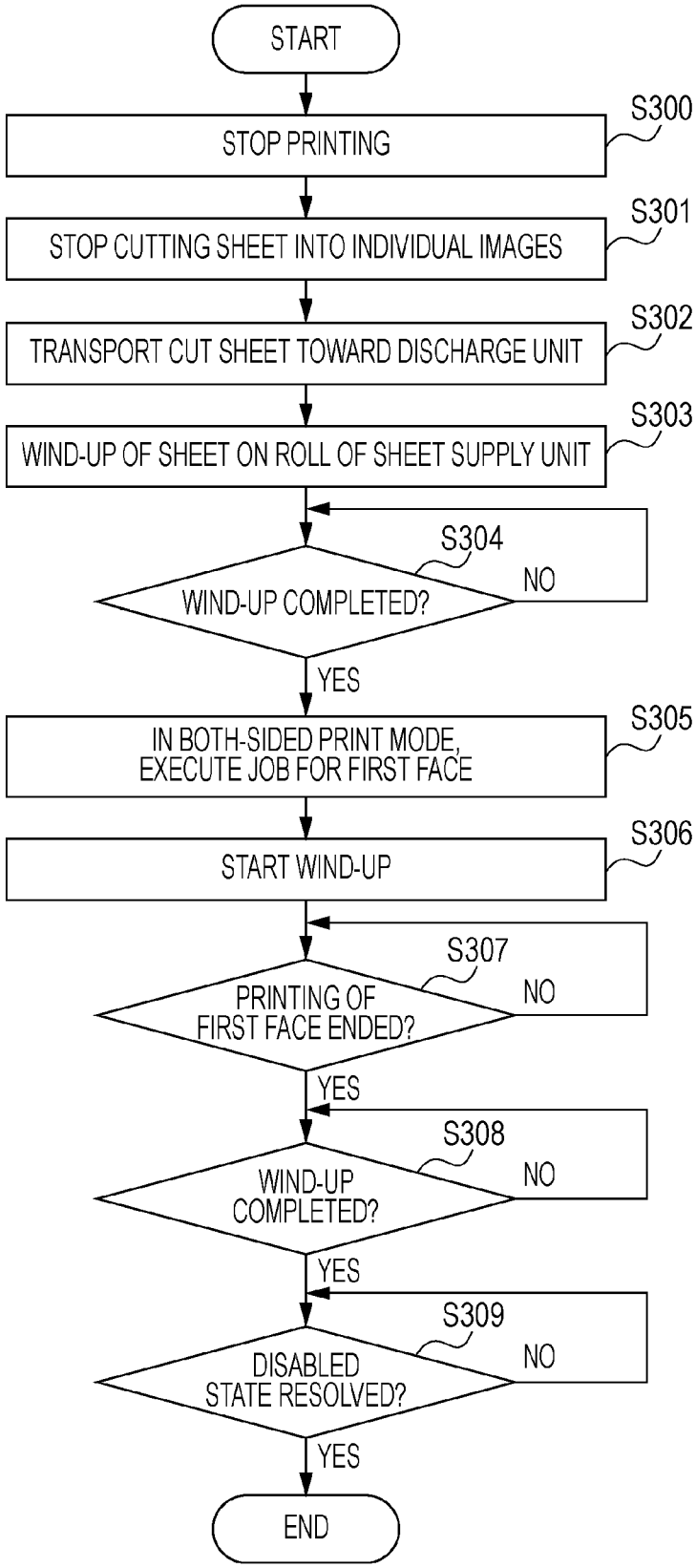
FIG. 8 is a flowchart illustrating processing in the event that a "disabled state" has been detected during printing.

FIG. 8 is processing for a case of a "disabled state" being detected while printing in the simplex printing mode, with a duplex job having been reserved following the simplex printing job. This corresponds to the case of (3-2) described above.

In step S300, the printing operation of the simplex printing job being executed is stopped. The timing for stopping printing may be partway through the job.

In step S301, the trailing edge of the image is cut at the timing of the last-printed image being sent to the cutter unit 6. No cutting is performed thereafter.

In step S302, cut sheets on the downstream path from the cutting position that have already been cut into unit images at the cutter unit 6 are conveyed to the path at the side of the discharge unit 12 (third path) and sent out. Thus, cut sheets are removed from at least the path from the cutter unit 6 to the discharge branching position.

In step S303, the sheet (continuous sheet) remaining upstream of the cutter unit 6 is sent back to the side of the sheet feeding unit 1, and wound onto a roll at the sheet feeding unit 1.

In step S304, completion of winding up is confirmed. In the event that winding up is completed, the state is simply the same as that before starting printing, except that the state is in the "disabled state". Upon confirming completion of winding up (YES), the flow advances to step S305.

In step S305, execution of the print job for the first surface in the duplex printing mode is started. In step S306, the sheet regarding which printing has been made on the first surface is wound up at the reverse unit 9. In step S307, the flow stands by until all images to be printed on the first surface have been printed. In step S308, the flow stands by until the sheet regarding which printing has been made on the first surface is wound up at the reverse unit 9. In step S309, the flow stands by until the "disabled state" is resolved and continuous discharge is available. In the event that the judgment here is YES, the sequence ends.

Thus, with this sequence, upon a "disabled state" being detected, printing is switched to printing of the first surface of the display printing at the print unit 4, and the sheets continuously printed are temporarily evacuated to the reverse unit 9. That is to say, as many jobs as possible are executed during the time that the user is performing maintenance as well, thereby improving the overall throughput. Note that printing of the simplex job is cancelled, so the remaining simple printing job is unexecuted. Accordingly, automatically adding a job reservation so that the unexecuted simplex job will be executed when the duplex job is completed, is desirable.

Note that employing this sequence is not indispensable, and that the sequence in FIG. 6 may be executed in all cases of a "disabled state" being detected in the simplex print mode, regardless of whether or not there is a subsequent duplex job reserved.

Figure 9:
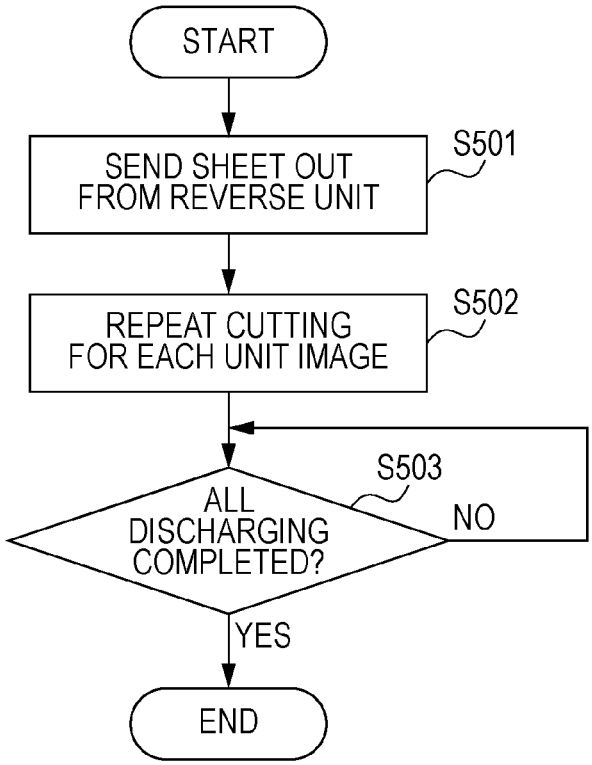
FIG. 9 is a flowchart illustrating processing after the processing in FIG. 8.

Next, the details of the processing in step S17 of the flowchart in FIG. 4 will be described with reference to the flowchart in FIG. 9. The processing here is the remaining processing up to completion of printing out of the entire process of printing, that was not executed in step S15.

In step S501, the sheet evacuated by winding at the reverse unit 9 is sent out, and sent to the cutter unit 6 again via the print unit 4.

In step S502, the sheet which has been printed on both surfaces is repeatedly cut into unit images. At this time, the sheet sent from the reverse unit 9 is not printed on, but cut marks are recorded in the margin region between the images (pages) at the printing unit. The cut marks recorded immediately before are detected at the cut mark sensor 19 of the cutter unit 6, and the sheets are cut with the cutter 20 based on this detection timing. The cut sheets pass through the drying unit 8 and are conveyed to the third path side, sorted at the sorter, and discharged.

The state in step S502 is either the state S403 or state S414 in FIG. 5. In the event that a "disabled state" occurs during this processing, the operation is temporarily stopped. The processing is resumed after the user performs maintenance and the "disabled state" is resolved. There is no need to perform printing in state S403 or state S414, so conveying at a speed the same as or faster than that when printing allows the overall printing throughput to be improved.

In step S503, determination is made regarding whether or not sorting and discharging of all printed cut sheets for all jobs have been completed. If so, this sequence ends.

According to the embodiment described above, a "disabled state" wherein sheets cannot be discharged at the discharge unit 12 during continuous printing is detected. Upon detecting a "disabled state", printing is continued at the print unit 4 and the sheet continuously printed is not cut into unit images at the cutter unit 6 but evacuated to the reverse unit 9. After the "disabled state" has been resolved by user maintenance, the sheet evacuated to the reverse unit 9 is sent to the cutter unit 6 again and cut into unit images and discharged at the discharge unit 12. That is to say, the printing apparatus is configured under a technical idea for the reverse unit 9 to be used as a storage unit serving as a buffer for temporarily evacuating sheets in the event that trouble occurs at the discharge unit 12, so that printing can be continued as much as possible even while the user is performing maintenance. Even if trouble does occur, part of the operations can be executed without stopping down the entire printing operation, so deterioration in printing productivity can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042346 filed Feb. 26, 2010, which is hereby incorporated by reference herein in its entirety.

What is claimed is:

1. An apparatus capable of duplex printing, comprising:

a sheet feeding unit configured to feed a sheet, wherein the sheet is continuous;

a print unit configured to perform printing on the sheet fed from the sheet feeding unit;

a cutter unit capable of cutting the sheet, which has been printed by the print unit, at a trailing edge of a print region and into a plurality of cut sheets;

a discharge unit configured to discharge the cut sheets;

a reverse unit configured to temporarily store the sheet for reversing and sheet feeding the reversed sheet to the printing unit again;

a detecting unit configured to detect a disabled state in which cut sheets cannot be discharged at the discharge unit;

and a control unit, wherein upon the disabled state being detected by the detecting unit while printing, the control unit controls to continue printing at the printing unit, and evacuate the sheet printed to the reverse unit for temporarily storing, without cutting into the cut sheets, and wherein after the disabled state is resolved, the control unit controls to send the sheet, which has been evacuated to the reverse unit, to the cutter unit so as to be cut into the cut sheets, and to discharge the cut sheets at the discharge unit.

2. The apparatus according to claim 1, wherein the reverse unit comprises a winding rotary member, and in the duplex printing, a sheet upon which a plurality of images have been printed on a first surface thereof at the print unit is wound onto the winding rotary member, subsequently, the winding rotary member rotates in a reverse direction such that the sheet wound thereupon is fed to the print unit again, and the plurality of images are printed on a second surface which is the back of the first surface of the sheet at the print unit.

3. The apparatus according to claim 2, wherein upon the disabled state being detected by the detecting unit while in a simplex printing, the control unit controls such that printing is continued and the printed sheet is evacuated to the reverse unit.

4. The apparatus according to claim 2, wherein upon the disabled state being detected by the detecting unit while printing the second surface in a duplex printing, the control unit controls such that the printing operation is stopped so as to stand by for the disabled state to be resolved.

5. The apparatus according to claim 1, further comprising a notifying unit configured to perform notification when the disabled state is detected by the detecting unit, so as to prompt a user to perform maintenance of the discharge unit.

6. The apparatus according to claim 1, wherein the disable state is a state in which jamming has occurred with sheet conveyance at the discharge unit, or in which sheets are stacked at the discharge unit to where the discharge unit is full or nearly full.

7. The apparatus according to claim 1, wherein upon the disabled state being detected by the detecting unit, the control unit controls such that a determination is made regarding whether the cut sheets can be discharged at the discharge unit, and in the event that the determination is made that the cut sheets cannot be discharged, the printing operation is stopped and notification is performed to prompt a user to perform maintenance.

8. The apparatus according to claim 1, wherein at a time of sending the sheet evacuated to the reverse unit to the cutter unit again, the control unit controls such that cut marks are printed by the print unit on the sheet without printing the images, and the sheet is cut at the cutter unit based on detection of the cut marks by a cut mark sensor.

9. The apparatus according to claim 1, wherein the control unit effects control such that printing in a duplex printing is executed within a sheet length restricted so as to not exceed a predetermined length corresponding to a sheet conveyance path used in the duplex printing, and upon the disabled state being detected by the detecting unit while printing on a second surface in the duplex printing, printing of the second surface is continued and the sheet printed continuously is evacuated to the reverse unit.

10. The apparatus according to claim 9, wherein the control unit controls such that the sheet regarding which the disabled state has been detected while printing the second surface and evacuated to the reverse unit is cut into the cut sheets at the cutter unit, and the cut sheets are discharged to a different tray of the discharge unit as to sheets discharged before detection of the disabled state.

11. An apparatus comprising:

a sheet feeding unit configured to feed a sheet, wherein the sheet is continuous;

a print unit configured to perform printing on the sheet fed from the sheet feeding unit;

a cutter unit capable of cutting the sheet, which has been printed by the print unit, at a trailing edge of a print region and into a plurality of cut sheets;

a discharge unit configured to discharge the cut sheets cut by the cutter unit;

a storage unit configured to temporarily store the sheet printed at the print unit and feed the stored sheet to the printing unit;

a detecting unit configured to detect a disabled state in which cut sheets cannot be discharged at the discharge unit;

and a control unit;

wherein upon the disabled state being detected by the detecting unit while printing, the control unit controls to continue printing at the printing unit, and evacuate the sheet printed to the storage unit for temporarily storing, without cutting into the cut sheets, and wherein after the disabled state is resolved, the control unit controls to send the sheet, which has been evacuated to the storage unit, to the cutter unit so as to be cut into the cut sheets, and to discharge the cut sheets at the discharge unit.

12. A method for controlling a printing apparatus including a sheet feeding unit configured to feed a continuous sheet, a print unit configured to perform printing on the sheet fed from the sheet feeding unit, a cutter unit capable of cutting a sheet which has been printed by the print unit into a plurality of cut sheets, a discharge unit configured to discharge the cut sheets, and a storage unit configured to temporarily store the sheet printed at the printing unit and feed the stored sheets to the printing unit, the method comprising:

detecting of a disabled state in which cut sheets cannot be discharged at the discharge unit;

continuing printing upon the disabled state being detected at the printing unit and evacuating the sheet printed upon to the storage unit without cutting into the sheet;

sending the sheet which has been evacuated to the storage unit to the cutter unit so as to be cut into the cut sheets after the disabled state is resolved; and discharging the cut sheets at the discharge unit.

* * * * *